United States Patent [19]

Rockhold et al.

[11] Patent Number: 4,772,028

[45] Date of Patent: Sep. 20, 1988

[54] ELECTRONIC SHOOTOUT GAME

[76] Inventors: Christopher K. Rockhold, 305 Hollyridge Cir., Peoria, Ill. 61614; Louis G. Alster, 1033 E. Polk, Morton, Ill. 61550

[21] Appl. No.: 90,015

[22] Filed: Aug. 27, 1987

[51] Int. Cl.[4] ..... A63F 9/02

[52] U.S. Cl. ..... 273/311; 434/22

[58] Field of Search ..... 273/310, 311, 312, 16 C, 273/1 E; 434/21, 22; 272/105, 71, DIG. 5; 340/323 R

[56] References Cited

U.S. PATENT DOCUMENTS

| | | | |
|---|---|---|---|
| 3,400,928 | 9/1968 | Weidacher | 340/323 R |
| 3,870,305 | 3/1975 | Harclerode | 273/311 |
| 4,545,583 | 10/1985 | Pearman et al. | 273/311 |
| 4,640,514 | 2/1987 | Myllylä et al. | 273/310 |

FOREIGN PATENT DOCUMENTS

| | | | |
|---|---|---|---|
| 2426479 | 1/1980 | France | 273/311 |

*Primary Examiner*—Leo P. Picard
*Assistant Examiner*—Jessica Harrison
*Attorney, Agent, or Firm*—Ralph E. Walters

[57] ABSTRACT

The present invention relates to an electronic shootout game and more specifically to such a game intended to be played by two contestants disposed in facing relation on a prescribed shooting field. The game accurately simulates the 19th Century gunfighting practice and is completely controlled by a programmable microprocessor which includes audio and visual display to control and track the progress of the game during play. The guns include a radio frequency transmitter and antenna system which broadcasts the firing and successful hit modes by wireless communication with the computer which provides an instantaneous readout of such game functions.

12 Claims, 4 Drawing Sheets

AMPLITUDE MODULATOR
RF TRANSMITTER
100
98
DRIVE
97
OSCILLATOR
95 Fc
58
92
TONE 1
94
TONE 2
59
GENERATING
LOGIC
Vcc
88
87
COCKED
85
90
SPRING
PHOTO SWITCH
FIRE
HIT
82
3 TO 70 FEET
15
66
68
RETRO-
REFLECTIVE
TAPE VEST
69
70
71
65
64a
72
67
PRE-
AMP.
74
64
DRIVE
75
DEMODULATOR
63
76
OPTICAL TRANSRECIEVER
62
PULSE
GENERATOR
GATE
INTEGRATOR
78
COMPARATOR
80
60

4/4

POWER
45
41
170
MC
65
137
MAT
122
FIRE A
126
FIRE B
124
HIT A
128
HIT B
STAND BY
POWER/R
ALL STATES
HIT A/BELL A
LIM A/ GRN.,R
184
185
177
172
MAT/R, RED
173
HIT B/ BELL B
LIM B/ GRN.,R
FIRE A/ BELL B
FIRE B/ BELL A
RED 171
HIT A/ BELL A
HIT B/ BELL B
MAT/GREEN, R,RED
A 180
B
GREEN 175
178
182
LIM B
LIM A
FIRE A/CLOCK A
FIRE B/CLOCK B
176
FIRE A/CLOCK A,SND. A
FIRE B/CLOCK B,SND. B
156
152
RED
142
GREEN
140
SND A
148
BELL A
143
SND B
149
BELL B
144
CLOCK B
CLOCK A
147
146
R
LIM B
LIM A
150
160
A COUNTER
166
154
162
B COUNTER

ELECTRONIC SHOOTOUT GAME

DESCRIPTION

1. Technical Field

The present invention generally relates to an electronic shootout game and more particularly to such a game for competition between a pair of facing contestants utilizing electronic guns capable of projecting a light beam toward a target member worn by the contestants with a computerized control system for regulating the game.

2. Background Art

Informal quick draw and shootout contests similar to the quick draw gun fighting practices of the 19th Century have long been a popular sport among people of all ages. These informal simulated games have normally used relatively harmless toy guns and a wide variety of other weaponry and amunition. These have included devices from the most crudely fashioned rubberhand shooting guns which were not very accurate to the more sophisticated impact disintegrating dye emitting projectiles which are objectionable for their permanent staining of any object struck by these projectiles. Other less fearful contestants have also been known to use B-B guns or other CO2 propelling lightweight plastic bullets all of which constitute a substantial safety hazard particularly to the eyes and other more sensitive areas of the body. This is especially true if the gun is discharged at very close range to a targeted person. More recently a more safety oriented electronic beam projecting gun has been used which include light emitting diodes for projecting an infrared beam for shooting at a remote target similar to the remote controls provided with many television sets. These, however, have not been found to be very dependable nor effective as a shootout game because of their very limited range, lack of accuracy, and susceptibility to external interference. It is therefore, recognized that an improved shootout game could be provided which utilizes a safe, dependable, electronic shootout gun substantially immune to outside interference and which is effective over a greater range than heretofore possible. Accordingly, the present invention is intended to overcome the problems as set forth above.

DISCLOSURE OF THE INVENTION

In accordance with one aspect of the present invention, there is provided an electronic shootout game for competition between a pair of facing contestants providing a pair of oppositely spaced starting stations with a shooting field traversable by the players between the stations with a pair of electrically powered game control monitors visible by the contestants from any position within the shooting field and a pair of optically emissive electronic guns individually carried by the contestants combining with a pair of retro-reflective members individually worn by the contestants serving as targets for the guns.

Another aspect of the present invention provides an electronic shootout game for competition between a pair of facing contestants including pressure sensitive mats providing safe areas at opposite ends of a shooting field traversable by the contestants with a pair of sets of electrically powered game control monitors visible by the contestants from within said shooting field and a pair of optically emissive guns individually carried by the players combining with a pair of retro-reflective members individually worn by the contestants serving as targets for the guns including a programmable microprocessor connected to the guns by a system of wireless communication which is electrically connected to the game control monitors for displaying and regulating the playing of the subject shootout game.

BEST OF MODE FOR CARRYING OUT THE INVENTION

Figure 1:
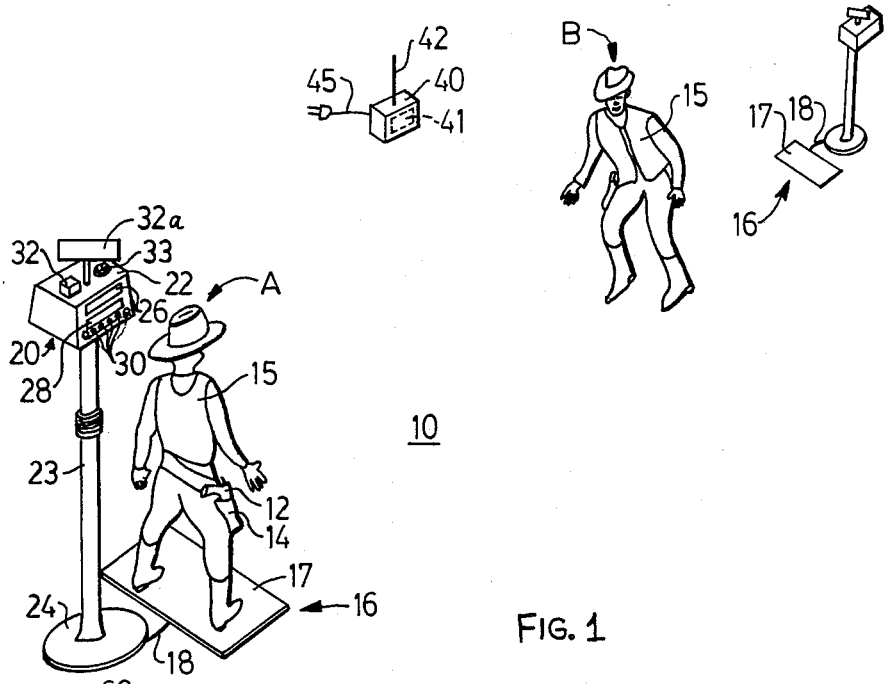
FIG. 1 is a pictorial three-dimensional view of the contestants and shooting field utilized by the shootout game of the present invention.

Referring more particularly to FIG. 1 of the drawings there is shown a contestant A and a contestant B disposed in facing relation at either side of a shooting field generally designated by the reference numeral 10. Each of the contestants carry an optically emissive gun 12 removably retained within a holster and belt 14 strapped about the waist of each contestant. A target vest 15 of retro-reflective material is worn by each of the contestants which provides a target having a substantial striking area for use during the contest. A starting area or safety station 16 is marked off at opposite sides of the shooting field 10. It has been found that a reflective sheeting material sold under the trademark "Scotchlite" by the 3M Company makes an excellent target. A pressure sensitive floor mat 17 is disposed within each of the safety stations 16 with each including a control wire 18 extended therefrom.

A substantially upright game control monitor generally indicated by the reference numeral 20 is disposed within each of the safety stations 16 and behind each of the floor mats 17. A display box 22 is mounted on the upper end of an elongated post 23 having an enlarged floor engaging base 24. Around the front and opposite sides of the display box there is provided an uppermost green light 26 and a lower red light 28 for depicting certain stages during the progress of the game. A series of six shot registering lights 30 are also disposed on the described sides and front of the display box beneath the red light 28. The display box further includes an electrically operated winners bell 32 and an audio speaker 33 from which a gun shot sound is appropriately broadcast which are both disposed on the top of the display box. Some other more entertaining winners display device may also be employed along with or in place of the bell such as a rotary sign such as that indicated by the reference numeral 32A.

A base station receiver 40 is disposed closely adjacent to the shooting field 10 which houses a micro-processor or computer 41. The base station has a omni-directional narrowband antenna 42 upwardly extended therefrom and an elongated power source line 45 adapted to be plugged into a source of 120 volt supply.

Figure 2:
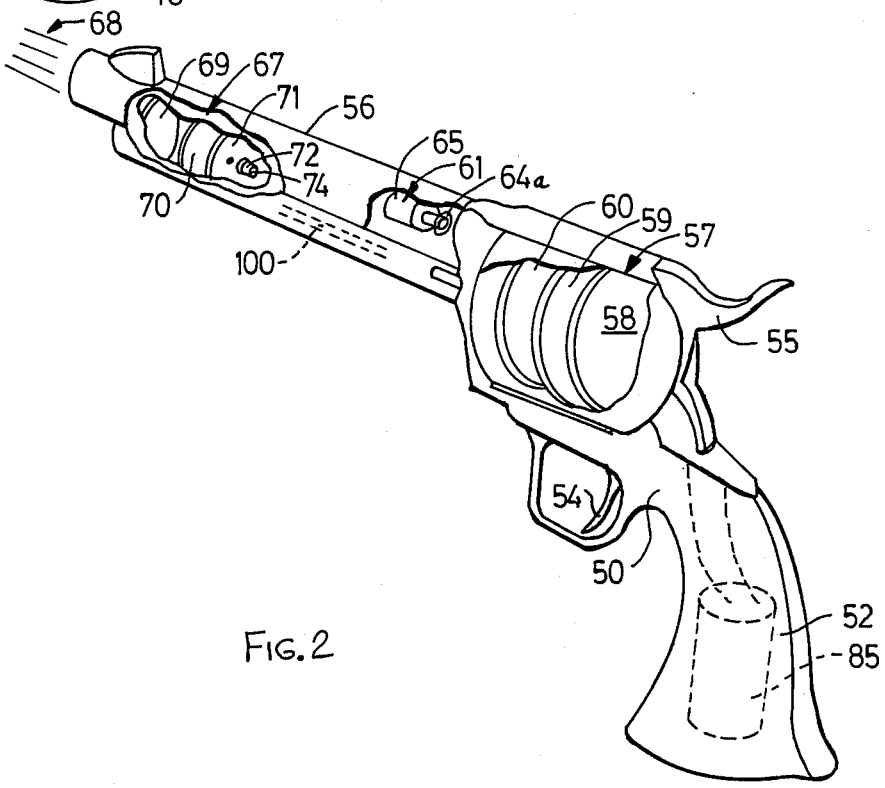
FIG. 2 is a somewhat enlarged three-dimensional view of the optically emissive gun carried by the contestants as shown in FIG. 1.

As best shown in FIG. 2 each of the guns 12 includes a frame 50 mounting thereon a hollow handle portion 52. The gun also has a trigger 54, a hammer 55 and an elongated barrel 56 forwardly extended therefrom. A cylinder 57 is removably mounted on the frame between the handle and the barrel which for illustrative convenience is divided into discreet sections including a radio frequency transmitter section 58, a logic generating circuit section 59 and an optical transceiver section 60. Depending on the size of the components these circuits may be physically intermixed within the cylinder in actual practice.

Figure 3:
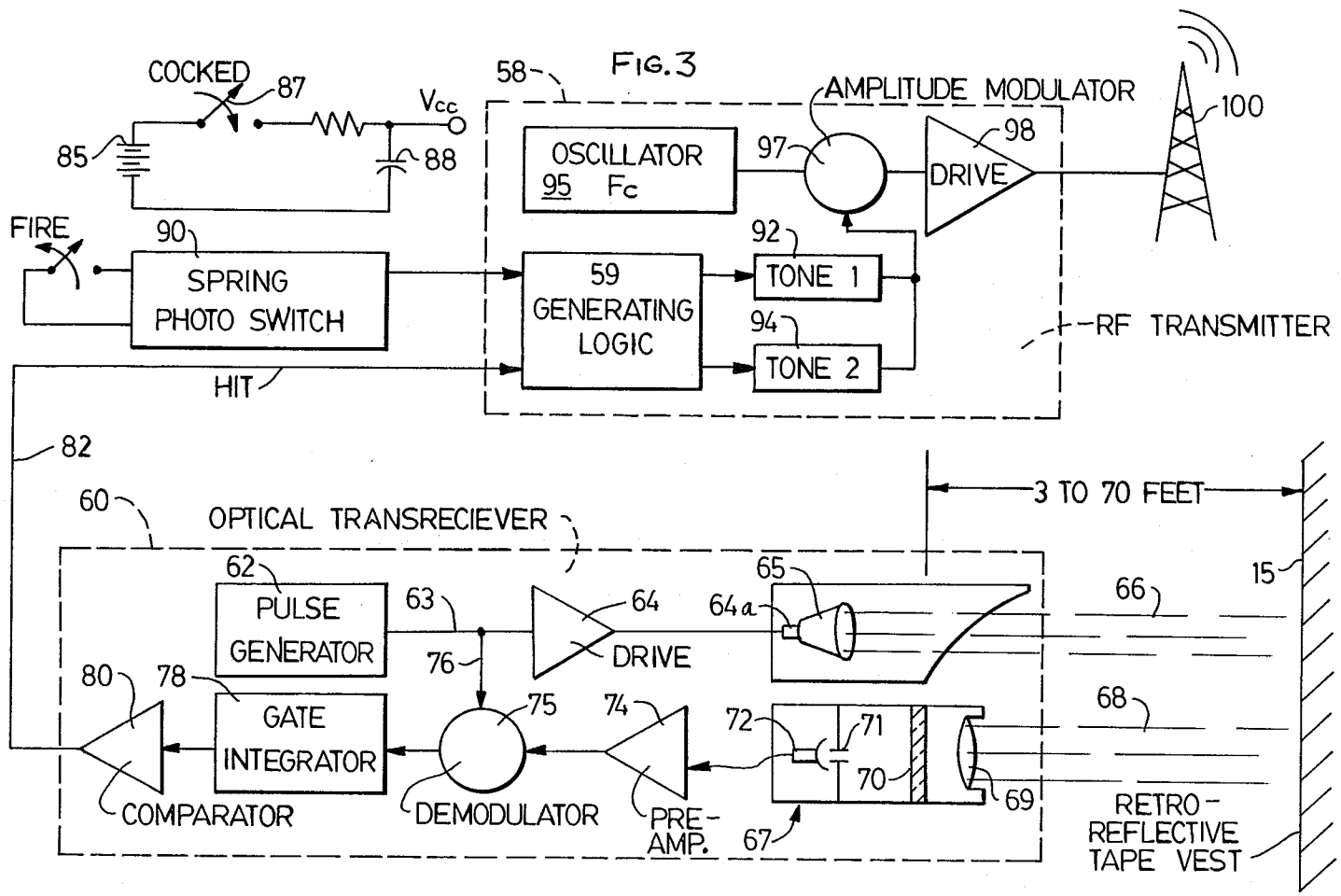
FIG. 3 is a schematic diagram of the electrical control circuitry present in the gun of FIG. 2.

The optical transceiver section 60 of the gun includes a series of beam transmitting optics generally indicated by the reference numeral 61 which is also shown in FIG. 3. Such transceiver provides a pulse generator 62 connectable through a series line 63 a current setting drive component 64. Said current activates a laser diode 64 A that produces radiant energy which is collected by a collimating lens 65 and beamed forward in a substantially parallel path to the gun barrel 56. Such beam transmitting optics is effective to project an elongated relatively low intensity eye-safe laser beam 66 toward the surface of the retro-reflective vest 15. A return or retro-beam 68 is then reflected back toward the gun 12 in a path substantially parallel to the beam 66.

The optical transceiver section 60 further includes a system of optics for receiving the retro-beam 68 by providing an objective lens 69 near the end of the barrel 56 of the gun 12. The return beam then passes through a wave length filter 70 and through a pinhole in a pupil stop disk 71. A photo detector component 72 receives the focused beam which is directed through a photodiode/pre-amplifier 74, a demodulator 75 which has a input line 76 communicated from the pulse generator circuit 62. The synchronously detected signal current is then directed through a gate integrator 78 and into a comparator unit 80 for discharge through a "hit" line 82 connected to the logic generating circuit of the cylinder 57 of the gun 12.

As best shown in FIG. 2, a dry cell battery 85 is mounted within the handle 52 of the gun 12 and is electrically connected to a circuit charging switch 87 mounted on the hammer 55 of the gun for briefly energizing a capacitor 88 shown in FIG. 3. A photo-optical switch 90 is associated with the trigger 54 of the gun for energizing the logic panel 59 to indicate a first "firing" tone depicted by a panel 92 or alternatively a second "hit" tone depicted in panel 94. The current generated by these tones, and one by a frequency oscillator 95, is directed to an amplitude modulator 97 and to a drive unit 98 for broadcast by an antenna 100 located within the barrel 56 of the gun 12. The radio frequency broadcast by the gun antenna, which is different for each gun, is readily picked up by the base receiving station antenna 42 for input to the computer 41 therein.

Figure 4:
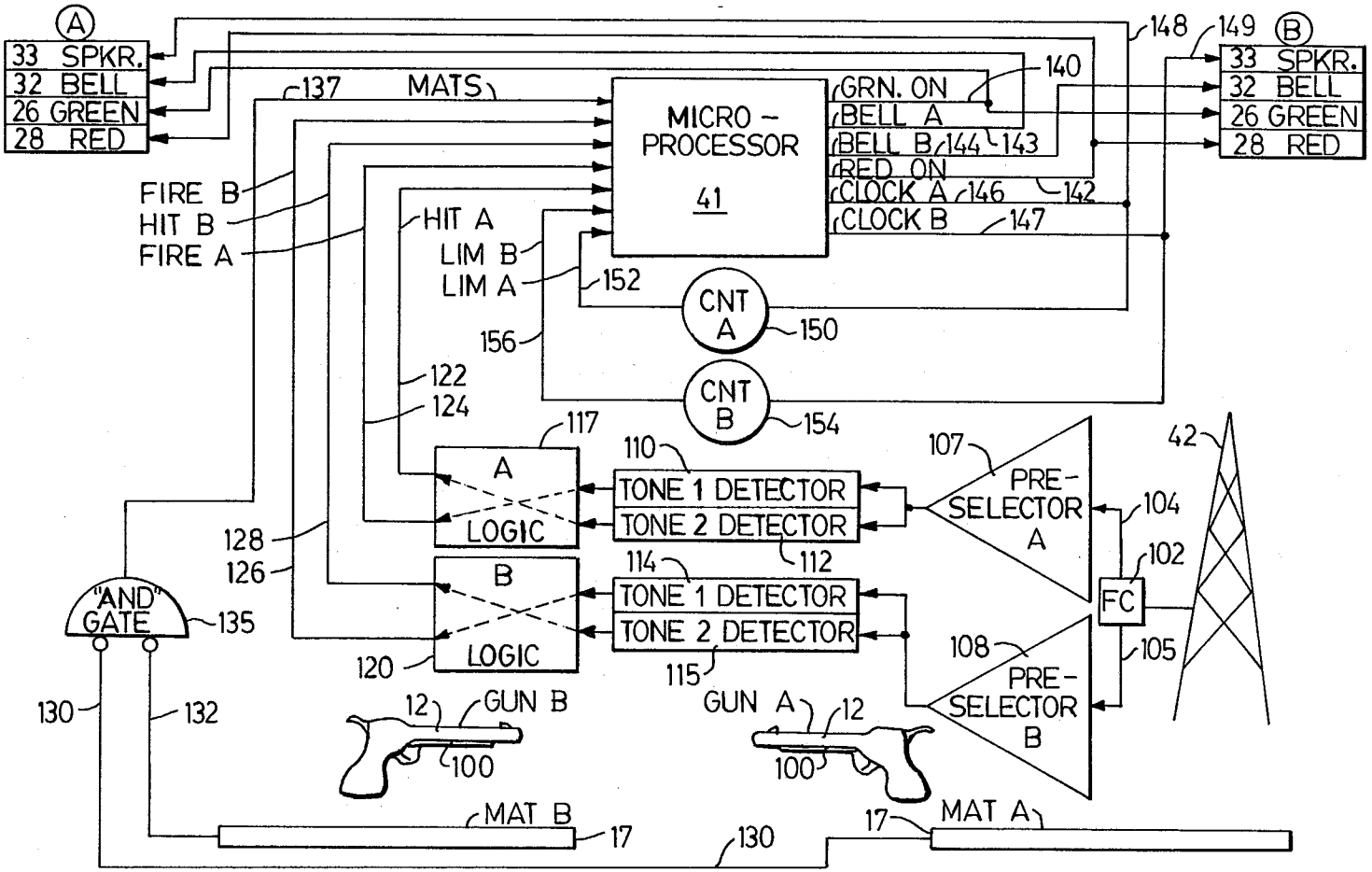
FIG. 4 is a schematic diagram of the overall electronic control circuitry including the micro-processor utilized with the present invention.

As best shown in FIG. 4 the antenna 42 of the base station receiver 40 directs the received signal to a power splitter 102 which provides a pair of output lines 104 and 105 respectively to share the signal of the guns 12 associated with contestants A and B. Such signal is directed to a pre-selector 107 for contestant A and a pre-selector 108 for contestant B. Each of these signals are then again split and detected into a firing tone 1 for contestant A indicated by a panel 110 and a second signal designated as a hit tone 2 depicted by a detector panel 112. Similarly, the contestant B signal is divided between a fire tone 1 shown in panel 114 and a hit tone 2 of a detector panel 115. These signals are individually directed into a logic panel 117 and 120 for the contestants A and B, respectively with the logic panel A having output lines 122 and 124 respectively designated as fire A and hit A which are connected to the microprocessor 41. Similarly, the logic panel 120 for contestant B includes output lines 126 and 128 respectively designating the fire line B and the hit line B also connected to micro-processor 41. A mat wire 130 for contestant A and a mat wire 132 for contestant B are both connected to an anding gate 135 which has a single outlet line 137 connected to the micro-processor. The anding gate is effective to require that both contestants step off of their respective mats 17 before the game can legally begin without penalty.

The micro-processor 41 provides a plurality of output lines including a green go light line 140 connected to the green light 26 on the control monitor box 22. A computer output line 142 designates a red stop light line which is connected to the red stop light 28 on the monitor. An output bell line for contestant A is indicated by the reference numeral 143 and a similar line 144 for the contestant B are individually connected to their appropriate bell units 32 on the monitors. A counter drive line for contestant A is designated by the reference numeral 146 and a similar line for contestant B designated 147 are connected to a pair of speaker lines 148 and 149 for connection to to their respective audio speakers 33 on the monitor. A counter for contestant A designated by the reference numeral 150 is connected to the counter line 146 and has a shot limiting input line for contestant A designated by the reference numeral 152 connected as an input to the computer 41. A second counter for contestant B designated 154 is similarly connected to counter line 147 and has a shot limiting input line for contestant B designated by the reference numeral 156 also connected to the computer 41.

Figure 5:
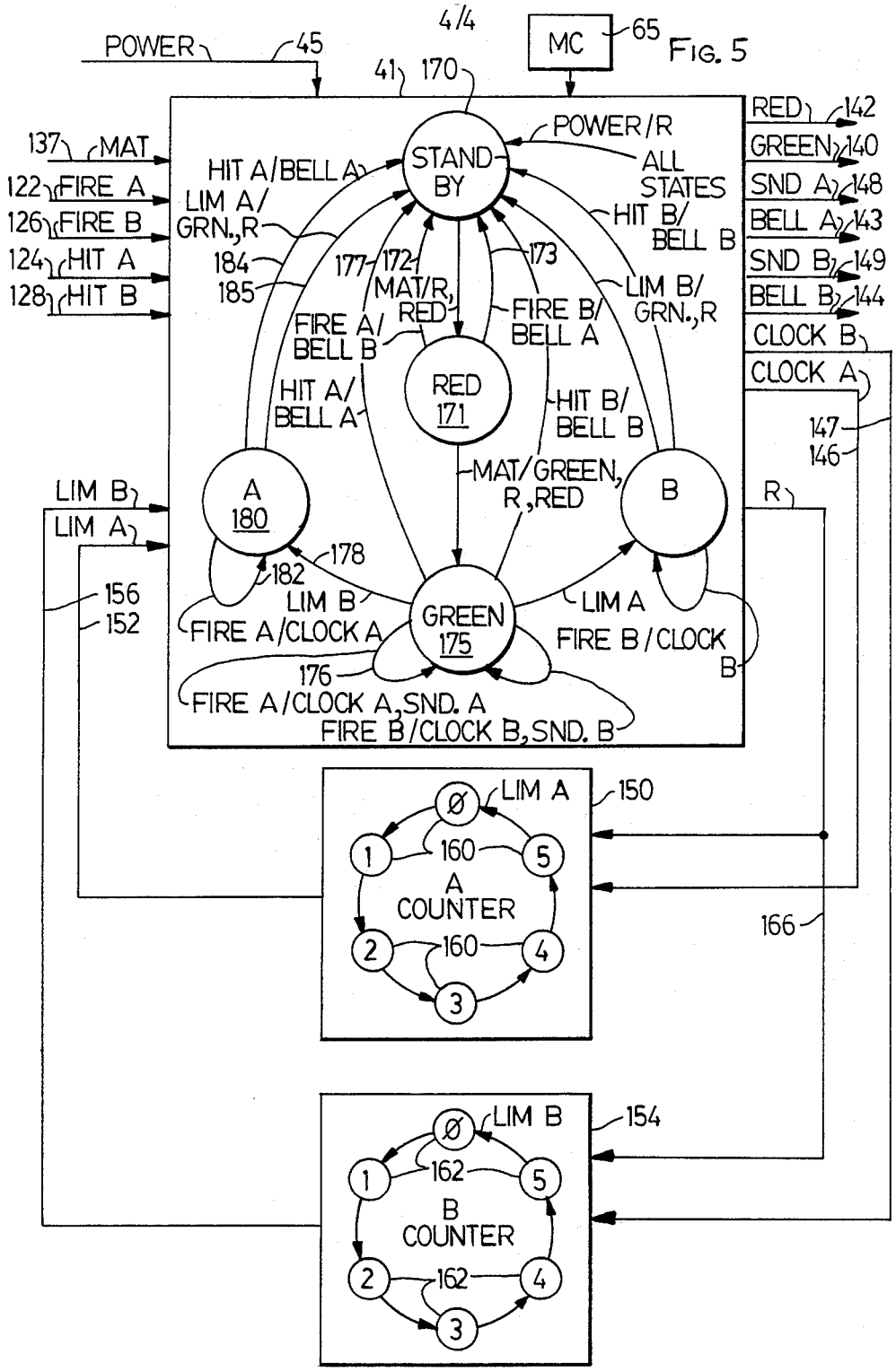
FIG. 5 is a schematic representation of the transitional steps plotting the flow of the contestants actions during the progress of the shootout game of the present invention.

The counters 150 and 154 are more specifically shown in FIG. 5 as including an arrangement of smaller "states" designating the number of shots taken by an individual contestant from zero to 5 which are indicated by the reference numeral 160 and 162 respectively. A master clock 165, depicted by the box labeled "MC", is connected to the computer 41 for a purpose to be described hereinafter. The computer is also connected by way of a reset line "R" or 166 to serve as a counter reset device, a contest reset device after a winner is declared or both contestants are out of shots or during the on power up sequence. With power provided through the line 45, a standby circle 170 is used to indicate the state of the computer during the power up condition as displayed by the monitor 20. During this condition of the system there are no contestants within the starting area 16 and all systems are temporarily on hold. Upon both contestants stepping on their respective mats 17, however, the red stop light 142 will be illuminated on both the monitors 22 which state is designated by the red circle 171. This transition is also depicted by the legend on the arrow extending between the circles 170 and 171 indicating "mat" on, "R" on, and "Red" on. If either of the contestants should prematurely fire their gun 12 while standing on the mat such condition is indicated by the line 172 returning the system back to the standby state of circle 170 at which time the winning bell 144 will sound for contestant B and the game is ended. A similar line 173 indicates a premature firing by contestant B with bell 143 sounding to indicate contestant A as the winner. If there are no premature firings the state of the game will progress to the green circle 175 which will light the green go light 26 on the monitor when both contestants have properly stepped off their respective mats 17 to initiate the start of the game.

A loop line 176 from circle 175 indicates the firing of contestant A's gun which through appropriate circuitry causes counter A to advance one notch and the sound of the shot to be broadcast by the speaker 33 through the appropriate monitor. Both contestants may then continue firing until all six shots are exhausted. If during such shooting mode contestant A scores a hit on contestant B's vest 15, contestant A's bell 33 will ring and the system returned to standby as depicted by line 177. If, however, contestant B's six shots are exhausted prior to contestant A's the line 178 will show a change in the state of the system to circle A designated by reference numeral 180. A loop off of such circle designated 182 will depict subsequent firings of contestant A's gun and continued indexing of counter A unless a hit is scored by contestant A as depicted by line 184 again returning the system to standby circle 170 after ringing the winner's bell for contestant A. If, however, contestant A fails to score a hit the system will be returned to the standby mode as designated by line 185 showing that contestant A has exhausted his six shot limit and it will be necessary to begin the game again.

Industrial Applicability

Prior to initiation of the game, it will be understood that both red lights 28 are activated when both players step on their respective mats 17. The first contestant that fires a shot while the red lights are on forfeits the game to his opponent. When both contestants A and B step off the mats the red lights go out and the green lights are activated to indicate initiation of the contest. Since the guns are connected to the micro-processor by wireless communication the system electronically monitors and keeps track and displays the number of shots taken by each contestant as they occur by the sequential illumination of the shot lights 30. It will noted that six shots are permitted for each contestant with the monitor displaying a visual and audio indication of the winner by detecting the first contestant to hit the reflective vest of the other contestant. It is apparent that there can be no ties with the game of the present invention. The winner is designated as the champion with the loser being relegated to the roll of challenger for any subsequent contest. During such play, the challenger must always step off the mat 17 first and advance toward the champion. The champion may then decide when to initiate the first shot. It is apparent that the contestants may advance or retreat during the shootout anywhere within the designated shooting field 10.

As described, each laser gun 12 communicates the results of the firing mode and the designation of a successful hit to the micro-processor controller 41 by way of the radio frequency modulation and detection circuits. Firing of the guns 12 is initiated by cocking the hammer allowing the hammer switch 87 associated therewith to charge the capacitor 88. After this, no current is drawn by the gun electronics until the contestant actually fires. When the contestant pulls the trigger 54 of the gun the photo-optical trigger or firing switch 90 immediately activates the carrier frequency oscillator 95 and tone one of the gun is energized. Simultaneously, the pulse generator and laser diode 62 of the optical transceiver are activated in the gun barrel. Also at this time, a signal is sent by the computer to the appropriate speaker 33 on the monitor producing the sound of a shot being fired. A string of light pulses are then projected from the collimating lense 65 aligned with the laser diode. If a "hit" is achieved, light in retro-beam 68 returned from the opponents retro-reflective vest 17 is collected by the objective lens 69, passed through the wave length filter 70, and optically stopped by the small pinhole in the stop disc 71. The pinhole sets the field of view of the receiver and blocks radiant energy that does not come from the area substantially in line with transmitted beam 66. Since the return beam is reflected back to the gun in the same direction that it was sent a very narrow field of view is thus permitted. With this arrangement it is very unlikely that the optics can be falsely triggered by any other external outside influence. Also any adverse background radiation is nearly eliminated from the system. The photo detector and pre-amplifier combination provides a very low noise profile for the ensuing synchronous detector circuitry. Because the optical beam traverses several feet in just a few nano-seconds a detected pulse arrives very nearly at the same time that the pulse generator has activated the laser diode.

As the light beam 66 strikes the reflective surface of the vest 15 the amount of energy returned depends on the amount of spread or diversion of the light within the returned beam. The retro-reflective surface of the vest 15 being similar to that of a cube-corner reflector, the angle of incidence of the beam will always equal the angle of reflection. Therefore, if the outgoing beam 66 strikes the vest in even an imperfectly perpendicular attitude the retro-reflective beam 68 coming back to the gun will be substantially precisely parallel to the outgoing beam and receipt of the beam into the receiving optics 67 of the gun will be assured. Despite minor losses of the signal from beams striking the vest surface at different angles from the perpendicular signal to noise calculations have shown the feasibility of detection to be effective for several hundred feet.

If a hit is registered by the transceiver 60 the logic circuitry 59 at the input of the RF transmitter 58 selects tone two to supercede tone one. Such tone modulates the carrier frequency of the appropriate gun and directs such signal to the gun antenna 100 for broadcast to the omni-directional, narrowband antenna 42 on the base station receiver 40. The antenna 100 is effective to efficiently convert electron flow of radio circuitry to electromagnetic radiation through a range of transmission of approximately 50 feet irrespective of which direction the gun may be pointed.

As best shown in FIG. 5 the fundamental operation of a game is depicted by a plurality of circuits which may be either hardwired or provided by software. The transition between various states of the system are shown by the arrows with such states of the system being retained by the utilization of memory devices within the program. These states constitute the momentary conditions of the system as a result of the inputs and outputs within the program with appropriate labeling on the arrows describing the input condition required for a particular transition from one state to another to occur.

The master clock 165 within the computer is programmed to continually provide the system with the opportunity to change from one state to the next. When the computer system is first powered up through line 45 such input forces any state within the system to immediately change to the standby state designated by circle 170 at the same time the counter reset line "R" or 166 is effective to reset the counters 150 and 154. Nothing more will happen at this point until both contestants step upon their pressure sensitive mats 17 to signal the start of the game. When this occurs, the input mat is powered up and the next signal from the master clock 165 will cause a transition to the red state or circle 171. As previously described any firing of either laser gun during the red state is not permitted. If a gun is fired during this state the game is automatically forfeited to the opponent. Accordingly, the transition arrow 172 which is labeled fire A/bell B or fire B/bell A of arrow 173 indicates that when input fire A or fire B is activated the opponents winning bell is energized and the system is returned to the standby state of circle 170 for the start of the next game. If no unauthorized shots are fired the only transition possible from the red state is that which is activated when both players step off of their respective mats 71. At that time, the mat input goes off and the green output goes on activating the green lights on both starting monitors thereby authorizing the contestants to commence firing. When this happens, the red state transitions to the green state as depicted by circle 175.

With the system in the green light state of circle 175 both contestants are permitted to fire at each other to the limit of their six shots as counted by the A and B counters 150 and 154 respectively. Whenever firing from either gun is detected the green state does not change but the outputs counter B/sound B and clock A/sound A are activated in a non-latching manner. These outputs sequence the counters until lim A and lim B, depicting the six-shot "limits", are delivered back to the input of the system and activate the bullet sound from the appropriate monitor box. If either hit A or hit B is activated the appropriate winner is declared by outputting either bell A or bell B. If either inputs lim A or lim B occur with all six bullets exhausted from either gun there is no output activated but the state is changed from green to either the circle A 180 or its corresponding circle B. In either of these states the fire, hit, and lim input of the opponent is ignored. The remaining contestant with shots left can do only one of two things. Either score a hit and win or also run out of shots. This is provided by the hit/bell legend of arrow 177 or lim/not green R legend of arrow 185 which then transitions to the standby state.

In view of the foregoing, it is readily apparent that the present invention provides an improved electronic shootout game utilizing long range laser guns for accurately projecting an electronic beam against a retro-reflective vest worn by the contestants with the beam being instantaneously reflected back and received by the gun with an immediate computerized display when a hit on the opponent is achieved. This is accomplished by the novel radio frequency broadcast system contained within the gun for wireless communication with the control computer located in the base receiver unit which readily receives the firing and hit commands from the gun no matter which direction the gun is pointed anywhere within the shooting field traversed by the contestants. The beam projected by the gun is completely harmless to humans with the receiving optics of the gun being substantially oblivious to external interference such as extraneous light sources and the like.

We claim:

1. An electronic shootout game for competition between a pair of facing contestants, comprising;

a pair of oppositely spaced starting stations individually including pressure sensitive mats providing safe areas on which the contestants stand prior to initiating the shootout;

a shooting field traverable by the contestants between said starting stations;

a pair of game control monitors connected to said mats being visible to the contestants from their positions on the mats and from any position within said shooting field;

a pair of battery powered optically emissive guns individually carried by the contestants;

and a pair of target members of retro-reflective material individually worn by the contestants.

2. The shootout game of claim 1 including a red stop light on said monitor providing a signal that both contestants are standing on their respective mats and ready to initiate the game;

and a green go light on said monitor providing a signal that both contestants have stepped off their respective mats to initiate the shootout.

3. The shootout game of claim 2 including electronic logic circuitry connected to said game control monitor and to said mats.

4. The shootout game of claim 3 in which said optically emissive guns individually include wireless means communicating with said logic circuitry by radio frequency waves generated during triggering of the guns.

5. The shootout game of claim 4 wherein said monitor has an audio speaker for broadcasting the sound of a gun shot during triggering of said guns;

and a winners indicator on each of said monitors energized by a hit of an optical emission from said guns on the opposing contestants target member.

6. The shootout game of claim 5 in which said guns are capable of projecting a beam toward said target members;

and said target members being a vest of retro-reflective material for reflecting said beam back toward said guns.

7. The shootout game of claim 6 in which said laser guns individually provide a hollow handle, a trigger and an elongated barrel;

a normally open switch electrically connected to said trigger and to said battery;

and a laser beam generating means mounted in said barrel having electrical connection to said trigger and battery.

8. The shootout game of claim 7 wherein said guns include a photo-electric beam detector means within the barrel in relatively closely spaced relation to said laser beam generating means to receive a reflected beam from said target vest on the contestants.

9. The shootout game of claim 8 in which said beam detector means includes an optical objective lens, a wave length filter, and a pupil stop disc having a pinhole to effectively limit the receiver field of view for blocking extraneous light sources from the system.

10. The shootout game of claim 9 including an antenna disposed within said barrel of each gun which are set at different frequencies;

and a omni-directional narrowband antenna projected from said logic circuitry for receiving radio-frequency waves from said gun antenna during actuation of said gun triggers.

11. The shootout game of claim 10 wherein said laser beam generating means in each of said guns includes a pulse generating circuit, a current setting drive unit, a laser diode and a collimating lens for projecting the beam outwardly from the gun barrel.

12. An electronic shootout game for competition between a pair of facing contestants on a computer controlled shooting field having oppositely spaced safe areas on which the contestants may stand prior to initiating the shootout with the contestants provided with laser beam guns and retro-reflective target vests, comprising the steps of:

requiring both contestants to step out of their respective safe areas before initiating firing said guns;

penalizing any contestant who prematurely fires while either contestant is on said safe area by forfeiting the game;

commencing firing after both contestants have departed said safe areas up to a limit of six shots;

continuing firing until a hit is scored by one contestant's laser beam striking the vest of the other;

providing a declaration of the winning contestant;

and resetting the system for the next game after such winner is declared or by the contestants return to said safe areas when all six shots are exhausted by both players without a winner.

* * * * *